US010021920B2

(12) United States Patent
McClellan

(10) Patent No.: US 10,021,920 B2
(45) Date of Patent: Jul. 17, 2018

(54) POCKET SQUARE HOLDER

(71) Applicant: Lukwon Tavalis McClellan, Nashville, TN (US)

(72) Inventor: Lukwon Tavalis McClellan, Nashville, TN (US)

(73) Assignee: MACK HABERDASHERY, LLC, Dallas, TX (US)

( * ) Notice: Subject to any disclaimer, the term of this patent is extended or adjusted under 35 U.S.C. 154(b) by 665 days.

(21) Appl. No.: 14/536,670

(22) Filed: Nov. 9, 2014

(65) Prior Publication Data

US 2015/0059062 A1 Mar. 5, 2015

Related U.S. Application Data

(63) Continuation-in-part of application No. 13/908,659, filed on Jun. 3, 2013, now abandoned.

(60) Provisional application No. 61/654,857, filed on Jun. 2, 2012.

(51) Int. Cl.
*A41B 15/02* (2006.01)

(52) U.S. Cl.
CPC ..... *A41B 15/02* (2013.01)

(58) Field of Classification Search
CPC ..... A41D 27/08; A41D 27/20; A41D 1/002; A41D 13/0015; A41D 13/01; A41D 13/05; A41D 1/02; A41D 25/00; A41D 2600/108; A41D 27/085; A41D 27/205; A41D 13/0017; A41D 13/002; A41D 13/012; A41D 13/015; A41B 15/02
USPC ..... 2/244, 279; 24/543; 150/153
See application file for complete search history.

(56) References Cited

U.S. PATENT DOCUMENTS

| | | | | | |
|---|---|---|---|---|---|
| 2,513,884 | A * | 7/1950 | Maurer | A41B 15/02 | 2/279 |
| 3,295,235 | A * | 1/1967 | Tauber | G09F 3/185 | 224/230 |
| 4,897,900 | A * | 2/1990 | Baggett | A41B 15/02 | 24/3.5 |
| D600,890 | S * | 9/2009 | Groves | D2/860 | |
| D692,636 | S * | 11/2013 | Lee | D2/500 | |
| D693,088 | S * | 11/2013 | Lee | D2/500 | |
| 2005/0133129 | A1* | 6/2005 | Saeed | A45C 1/06 | 150/135 |
| 2012/0227295 | A1* | 9/2012 | Miller | G09F 3/201 | 40/304 |

* cited by examiner

*Primary Examiner* — Alissa L Hoey
*Assistant Examiner* — Catherine M Ferreira
(74) *Attorney, Agent, or Firm* — Smith Tempel Blaha LLC; Gregory Scott Smith

(57) ABSTRACT

An apparatus is provided for holding pocket squares/handkerchiefs using different folds and configurations. The device includes two panels that can be folded over each other along a single edge and securely held together. A pocket square, inserted into an interior space defined by the folded panels can thus be held in position. Ample space is provided on the device to display monograms, advertisements, or other decorative elements.

8 Claims, 9 Drawing Sheets

POCKET SQUARE HOLDER

CROSS REFERENCE TO RELATED APPLICATION

This is a utility patent application being filed in the United States as a non-provisional application for patent under Title 35 U.S.C. et seq. and 37 C.F.R. 1.53(b) as a continuation-in-part of the United States application for patent that was filed on Jun. 3, 2013 and assigned Ser. No. 13/908,659, which application is a non-provisional application of and claims priority to the U.S. Provisional Patent Application that was filed on Jun. 2, 2012 and assigned Ser. No. 61/654,857, all of which are herein incorporated in their entirety by reference.

BACKGROUND OF THE INVENTION

The present application relates generally to handkerchief holding and displaying devices, and more specifically it relates to a pocket square/handkerchief holding device for holding a handkerchief or a pocket square in place, keeping the form of any fold of the handkerchief or pocket square, and displaying the folded pocket square/handkerchief in the outside breast pocket of a garment.

You only get one chance to make a first impression. Whether it is that awesome date opportunity, the interview for the killer job, the big client acquisition or returning to your home town for the 20 year class reunion, you need to make the most of the opportunity. For men, a huge impression is made by the limited amount of accessories that can be worn—and socially accepted. One of these accessories is the shoes. They must shine like a star and be scuff free. Anyone raised by a military father will have had this engrained into his or her being. Another accessory is the tie. The tie has to make a huge impact by not only matching and bringing out threads from the suit and shirt, but it has to be tied right. The knot must be perfect with a clean dimple, and the ratios of the fat and skinny parts must be on point. In the past, and increasingly more so recently, another accessory for men is the pocket square. Now, one can take a pocket square and shove it into a coat pocket with a portion hanging out but, the public perception is going to be "ho hum". Even if one finds the perfect pocket square to work with the tie, suit and shirt, the impact of the pocket square can be greatly diminished if it isn't folded properly, so that the exposed portion of the pocket square presents a neat appearance. In addition, once folded and placed in the coat pocket, over time and as a result of physical activity or taking the coat off and on, the fold of the pocket square may become disheveled or the pocket square may drop down into the pocket, disappearing entirely. Dull shoes, improperly skewed tie, disheveled pocket square—you just may miss the big opportunity.

Various forms of handkerchief holding devices have been in use for years. Typically, clothing items, such as suit jackets and shirts, include a pocket (such as a breast pocket) in which a handkerchief may be received and displayed. Unfortunately, due to the movement or activity of the wearer, the handkerchief or pocket square does not always maintain its shape and height in the pocket as positioned. Over time, the handkerchief loses its shape and height and may no longer be visible or may have an unwanted configuration in the pocket. Different mechanisms have been employed to assist in presenting the handkerchief. For example, some handkerchiefs may be purchased already folded, with cardboard around the handkerchief, ensuring that part of the handkerchief is visible from the pocket. Other breast pockets have the appearance of a handkerchief or pocket square permanently stitched into the pocket, whereby the appearance is constant and unchangeable and also, the handkerchief is unusable as a wiping tool. Further, other handkerchief holders of the prior art are bulky or may have unwanted protrusions, which may be unflattering in the pocket or which may even damage the pocket or the pocket square/handkerchief.

SUMMARY

The present disclosure presents various embodiments of a pocket square holder, as well as configurations, aspects, features and the like of a device for securing and holding a pocket square in one's suit jacket pocket. The various embodiments of the pocket square holder may be configured to be free of unwanted protrusions, made in particular dimensions and out of a material so as not to damage the pocket, make provisions for fashionable designs to be placed thereupon, and allow the user to use the handkerchief/pocket square as a wiping tool or other useful purposes germane to handkerchiefs. It is with respect to these considerations and others that various embodiments of the present invention have been made.

This summary provides an introduction to a selection of concepts in a simplified form that are further described below in the greater detail. This summary is not intended to identify key features or essential features of the claimed subject matter, nor is it intended to be used to limit the scope of the claimed subject matter.

In view of the foregoing disadvantages inherent in the known types of pocket square/handkerchief holding and displaying devices now or previously present in the prior art, the presented embodiments provide a new pocket square/handkerchief holding and displaying device wherein the same can be utilized for efficiently and effectively positioning in different decorative configurations and securely retaining a pocket square/handkerchief or other like object within the breast pocket of an article of clothing, which is free of protrusions and made out of a material which will not damage the pocket or the pocket square/handkerchief. Further, in some embodiments, pockets may be disposed thereupon for holding other items, such as business cards.

Other apparatuses, systems and methods according to various embodiments will be or become apparent to those of ordinary skill in the relevant art upon review of the following drawings and detailed description. It is intended that all such additional apparatuses, systems and methods be included within this description.

DETAILED DESCRIPTION

As briefly described above, embodiments are directed to providing an apparatus for holding pocket squares/handkerchiefs, using a novel and non-obvious holding device. Throughout this description, the term pocket square will be used to generically describe pocket cloths, handkerchiefs, etc. It will also be appreciated that various features, aspects and characteristics are described herein as being in an exemplary embodiment. It should be understood that reference to an exemplary embodiment does not necessarily mean the same embodiment and, features, aspects and characteristics described in one embodiment may also be incorporated into or excluded from being incorporated into other embodiments.

Some of the embodiments incorporate textured materials so that the pocket squares will not lose their shape when placed in a jacket pocket and while the user is engaged in activities, whereby the pocket square might be impacted. In the following detailed description, references are made to the accompanying drawings that form a part hereof, and in which are shown by way of illustrations specific embodiments or examples. These embodiments may be combined, other embodiments may be utilized, and structural changes may be made without departing from the spirit or scope of the present invention. The following detailed description is therefore not to be taken in a limiting sense, and the scope of the present invention is defined by the appended claims and their equivalents. In all embodiments, the lengths and circumferences may be varied in the actual products so as to accommodate usage parameters, environmental variances and comfort of the user of the device; however, particular dimensions provided herein are also considered novel aspects of some embodiments.

Figure 1B:
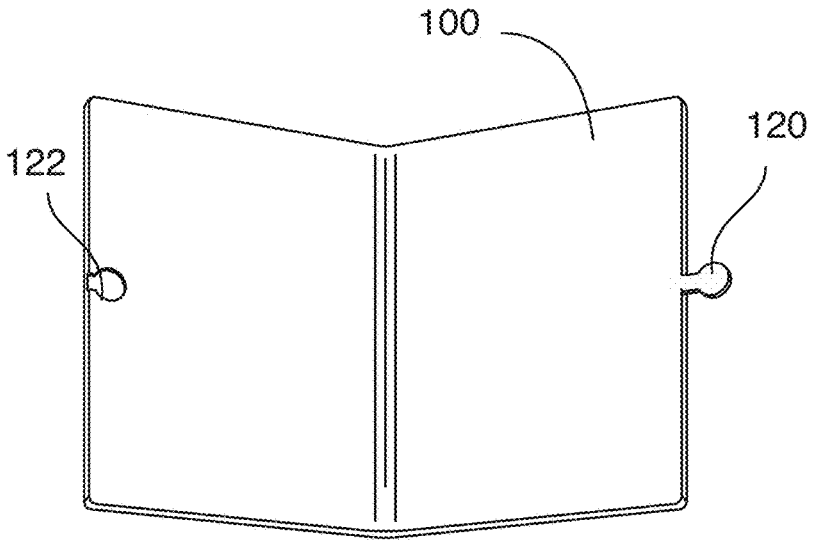
FIG. 1A, FIG. 1B and FIG. 1C, collectively referred to as FIG. 1, are various views of an embodiment of pocket square holder with a soft clasp.
Figure 1A:
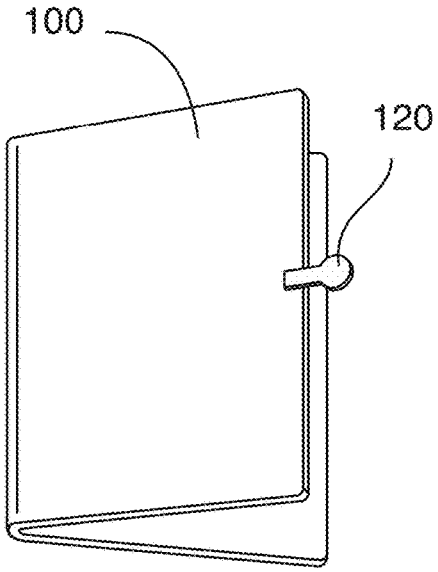
Figure 1C:
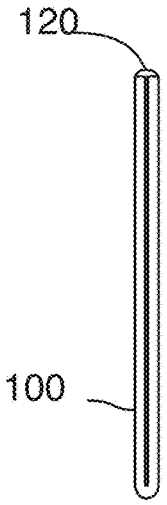

FIG. 1A, FIG. 1B and FIG. 1C, collectively referred to as FIG. 1, are various views of an embodiment of pocket square holder with a soft clasp. FIG. 1 shows three views of a bi-fold embodiment of invention pocket square holder 100, with an attaching mechanism. In the illustrated embodiment, the attaching or closing mechanism includes a strap with a plug 120 extending from a first edge of the holder 100, and a receptor 122 embedded proximate to an opposing edge of the holder 100, referred to as a soft clasp. One of ordinary skill in the relevant art will appreciate that many attaching mechanisms may work with the various embodiments of the holder and that the soft clasp is a non-limiting example of one such mechanism.

In some embodiments, the holder may be made at dimensions suitable for being inserted into a standard size pocket. In addition, multiple sized holders may be created for differing standards, such a men's coats, women's coats, children's coats, etc. In addition, embodiments of the holder may be made for custom sized pockets, as well. In one exemplary embodiment, the holder may be dimensioned to be 3 inches (x-dimension) by 4 inches (y-dimension). When closed, the entire holder is approximately 1 millimeter (z-dimension), so as not to create a bulging effect in the pocket of the garment. In the embodiment illustrated in FIG. 1, a soft clasp for securing the holder 100 is illustrated.

Figure 2A:
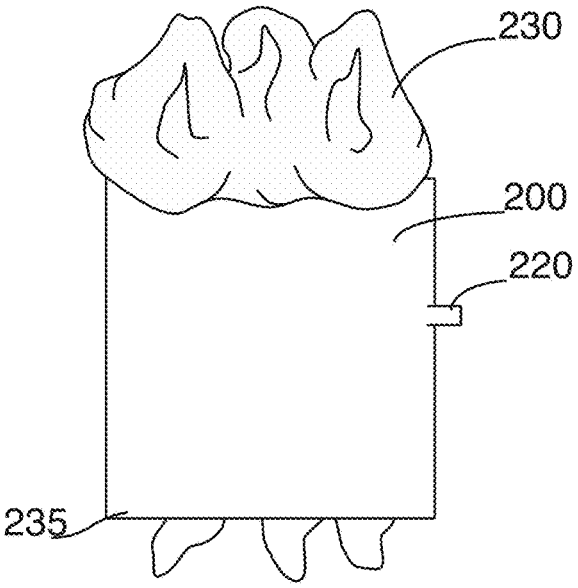
FIG. 2A and FIG. 2B present a view of the embodiment of FIG. 1 holding a pocket square folded in a "Utopian Puff" configuration prior to being installed in a pocket (FIG. 2A) and after being installed in a pocket (FIG. 2B).
Figure 2B:
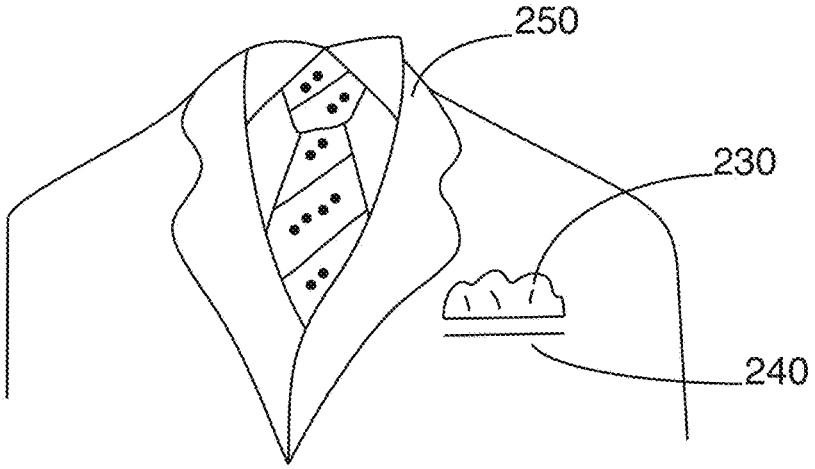

FIG. 2A and FIG. 2B present a view of the embodiment of FIG. 1 holding a pocket square folded in a "Utopian Puff" configuration prior to being installed in a pocket (FIG. 2A) and after being installed in a pocket (FIG. 2B).

The illustrated embodiment of the pocket square holder 200 illustrates a pocket square 230 folded or bunched in a "Utopian Puff" configuration. Here, the user folds or bunches the pocket square/230 and encloses it within the holder 200. Notice that the pocket square 230 may or may not protrude out of the bottom 235 of the holder 200 as the attaching mechanism in the illustrated embodiment is shown as existing on the side of the holder, thus allowing the pocket square 230 to protrude out the bottom 235 if so desired. FIG. 2B illustrates a conceptual view of how the pocket square 230 in the Utopian Puff configuration will appear in the breast pocket 240 of a suit jacket 520 when using the illustrated embodiment of the holder 200.

Figure 3A:
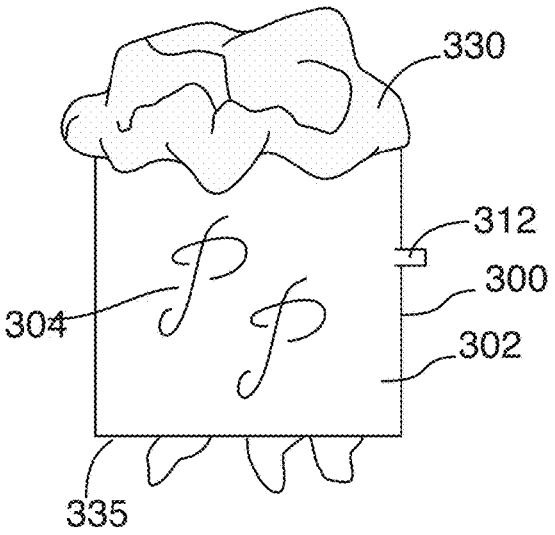
FIG. 3A and FIG. 3B present a view of the embodiment of FIG. 1 holding a pocket square folded in a "Flower Puff" configuration prior to being installed in a pocket (FIG. 3A) and after being installed in a pocket (FIG. 3B).
Figure 3B:
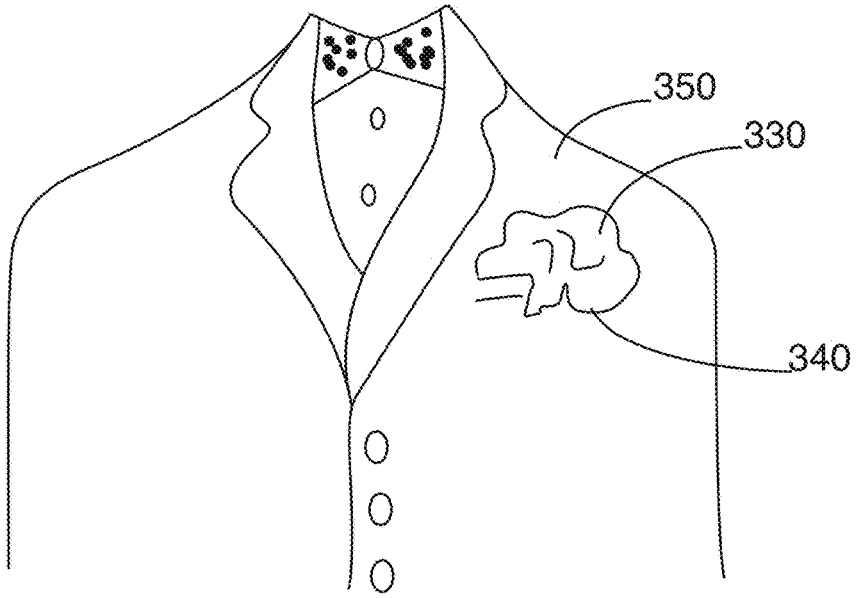

FIG. 3A and FIG. 3B present a view of an embodiment of a pocket square holder with a pocket square folded in a "Flower Puff" configuration prior to being installed in a pocket (FIG. 3A) and after being installed in a pocket (FIG. 3B). In the illustrated embodiment, a, user folds or bunches the pocket square/handkerchief 330 and encloses it in the holder 300. Notice that the pocket square/330 may or may not protrude out of the bottom 335 of holder 200 because the attaching mechanism 312 is positioned on the side of the holder 200 rather than the top or bottom. FIG. 3A also illustrates how a design or insignia can be placed on an outside surface 302 of the holder 300. In the illustrated embodiment, the insignia "P P" i304 is illustrated. Such insignias may be carved into the leather, embroidered, painted, stained, sewn in place, etc. FIG. 3B illustrates how the Flower Puff configuration will appear when placed within the breast pocket 340 of a suit jacket 350 when using the illustrated holder 300.

Figure 4B:
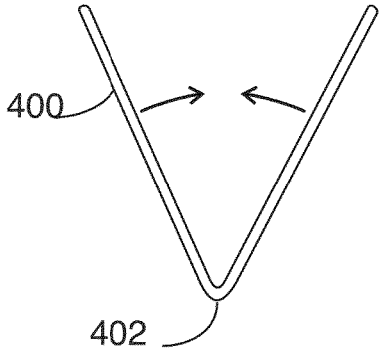
FIG. 4A, FIG. 4B and FIG. 4C, collectively referred to as FIG. 4, show various views of another embodiment of the pocket square holder.
Figure 4C:
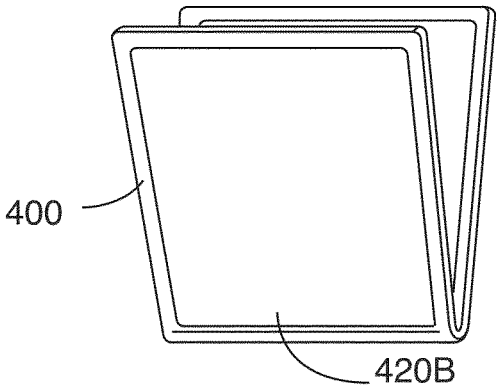
Figure 4A:
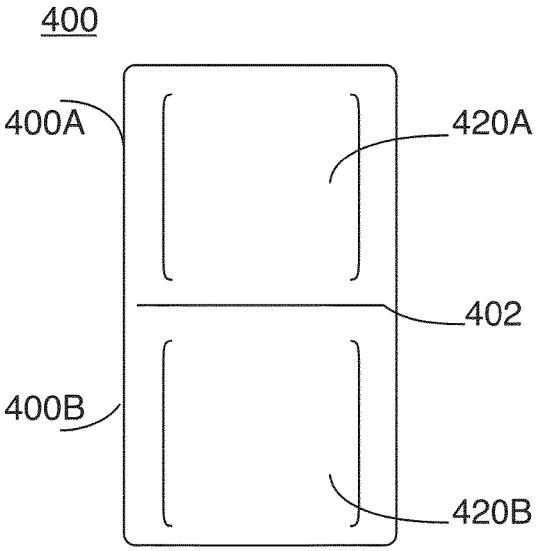

FIG. 4A, FIG. 4B and FIG. 4C, collectively referred to as FIG. 4, show various views of another embodiment of the pocket square holder. FIG. 4A is an plan view of the holder 400 in the open position. FIG. 4B is a side view of the holder 400 in a partially closed position. FIG. 4C is a perspective view of the holder 400 in a partially closed position. In the illustrated embodiment, the two sides of the holder 400A and 400B are held together by magnetic devices 420A and 420B that are embedded within the holder 400. In this embodiment, the user may use magnetic contacts 420A and 420B to hold a folded or bunched pocket square. This embodiment shows a "v" configuration (see FIG. 4B) where any folded or bunched pocket square will not protrude out of the bottom 402 of the holder 400, but will instead rest at the bottom of the fold between the two panels 400A and 400B of the holder 400. Thus, magnetic material or devices may be used within the holder to hold the pocket square in place. As a non limiting example, the dimensions of the holder 400 may be approximately 3 inches (x-dimension), approximately 4 inches (y-dimension) and approximately 1 millimeter (z-dimension). Note that no external or protruding clasp is shown in this embodiment as magnets accomplish this purpose. It should be appreciated that the dimensions are provided for illustrative purposes only and are actually sized to ensure a secure fit within a pocket. For instance, for a 3 inch pocket opening, the width of the pocket square holder may be listed as 3 inches but in fact, it may be slightly less to ensure ease of insertion and removal from the pocket without causing any binding or bending of the holder but, not so less to allow the holder to freely move about in the pocket by sliding left or right. In addition, the magnetic mechanism may include a magnet sheet, magnetic pills or any of a variety of other shapes and sizes. The magnets may be embedded within the holder material or may be attached to the surface of the holder material. In addition, one panel of the holder may include magnets while the other panel may simply include a magnetic material.

In addition, other embodiments may use any of a wide variety of other techniques to secure the holder. For instance, some embodiments may utilize one or more snaps, hook and loop elements, zippers, buttons, elastic straps, as well as any combination of these and/or other techniques.

Figure 5A:
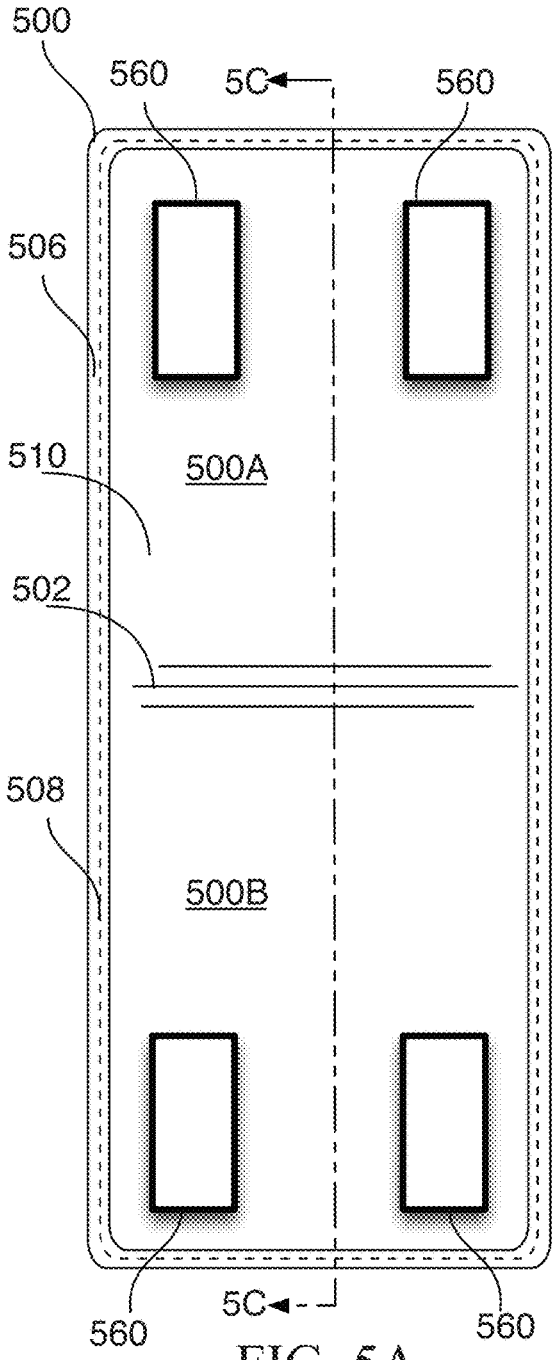
FIG. 5A is an interior plan view of a four magnet version of the pocket square holder.
Figure 5B:
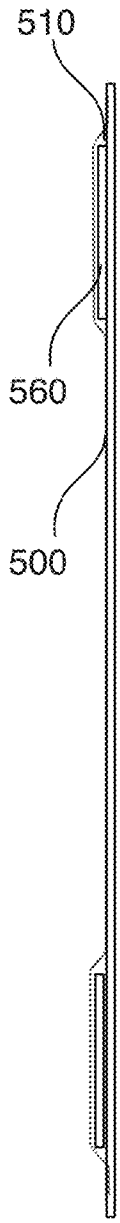
FIG. 5B is a side elevation view of the embodiment of FIG. 5A.
Figure 5C:
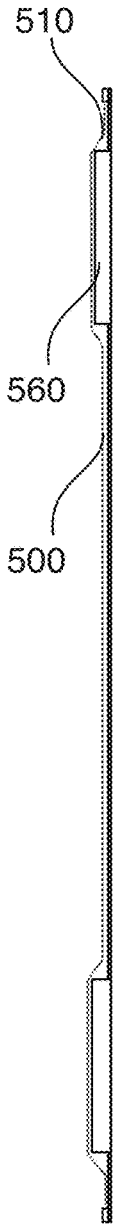
FIG. 5C is a cross-sectional view of the embodiment of FIG. 5A taken at line 5C.

FIG. 5A is an interior plan view of a four-magnet version of the pocket square holder. FIG. 5B is a side elevation view of the embodiment of FIG. 5A. FIG. 5C is a cross-sectional view of the embodiment of FIG. 5A taken at line 5C. FIG. 5A is a plan view of another embodiment of the pocket square holder in an open position. The holder 500 is shown as including two panels, panel 500A and 500B that are joined together along a common seem 502. The outside of the holder 500 is shown as wrapping around to the interior of the holder 500 as illustrated by the hem 506. Another material, the same or different from the outside material, is used as a liner 510 on the interior of the holder. In an exemplary embodiment, the material of the exterior may be a soft, high-quality leather and the material of the interior lining 510 may be a decorative material, such as silk, polyester, etc.

As best seem in FIG. 5A, four magnets 560 are utilized for the securement of the holder 50 in a closed position. The magnets 560 are approximately ⅜ inches by 1 inch and approximately 1/16 of an inch or less in thickness. The interior edges of the magnets 560 are approximately 1⅛ to 1¼ inches apart to create a gap for the pocket square material and, the outer edge of the magnets 560 are approximately ⅜ to ½ inches from the side edge of the panel 520A and 520B. In this embodiment, the magnetic contacts 560 allow the holder 500 to be free from any protruding clasps.

In operation, a user will fold a pocket square to a desired shape and lay the pocket square flat along one panel of the opened holder 500 such that a decorative portion of the pocket square is hanging over a top edge of the panel. The holder 500 can then be folded onto itself along the seem or fold 502 such that the magnets 560 in panel 500A come into alignment with the magnets 560 in panel 500B. The pocket square is then secured between panel 500A and 500B within an interior space defined by the folded panels and is further secured by being held between the magnets 560 of panel 500A and 560 of panel 500B. The holder with the folded pocket square can then be placed within a jacket pocket or stored in a drawer for later use.

It should be appreciated that in some embodiments, the panels may not be the same width or height. For instance, one panel may be sized to fit snuggly within the interior of a pocket while the other panel may be smaller in width, height or both. The materials for the various embodiments may vary and may include, as non-limiting examples, various hides, snake skin, eel, ostrich, plastic, cloth, silk, polyester, cotton, linen, etc. In addition, although the panels have been described and illustrated as being substantially rectangular, the actual shapes may vary by including tapered edges, rounded corners, etc.

The types, shapes, sizes and strength of the magnets and/or magnetic material used in various embodiments may vary. However, the gauss rating of the magnets should be sufficient to provide a secure holding strength such that the pocket square will not easily be pulled or moved but, that can still allow a typical user to open the panels of the holder without damaging the holder or the pocket square within the holder.

FIG. 5B is a side view of the holder 500 illustrating that the interior liner 510 is positioned over the magnets 560. This allows the pocket square to be protected from any particles that may come off of the magnet 560 and, also helps to soften the edge of the magnets so as not to snag the packet square material. FIG. 5C is a cross-sectional view of the holder 500 taken at line 5C of FIG. 5A. As can be seen in FIG. 5C, in this embodiment the interior liner 510 is tucked under the hem 506 of the exterior material and as best seen in FIG. 5A, is held together by stitching 508; however, glue, adhesive, staples and/or other techniques may also be used.

Figure 6:
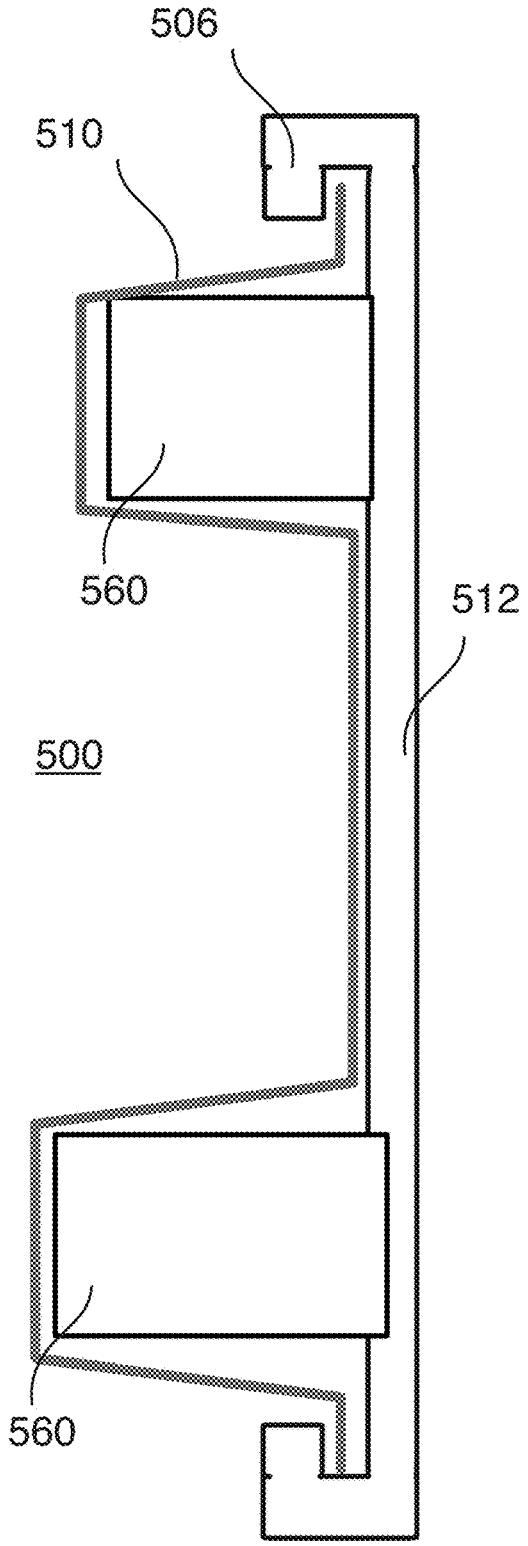
FIG. 6 is an exaggerated view of the cross-sectional view of FIG. 5C to better illustrate the construction of an exemplary embodiment of the holder.

FIG. 6 is an exaggerated view of the cross-sectional view of FIG. 5C to better illustrate the construction of an exemplary embodiment of the holder. The holder 500 includes the outside material 512 and the inside material 510 which is tucked under and secured to the hem of the outside material 512.

Figure 7:
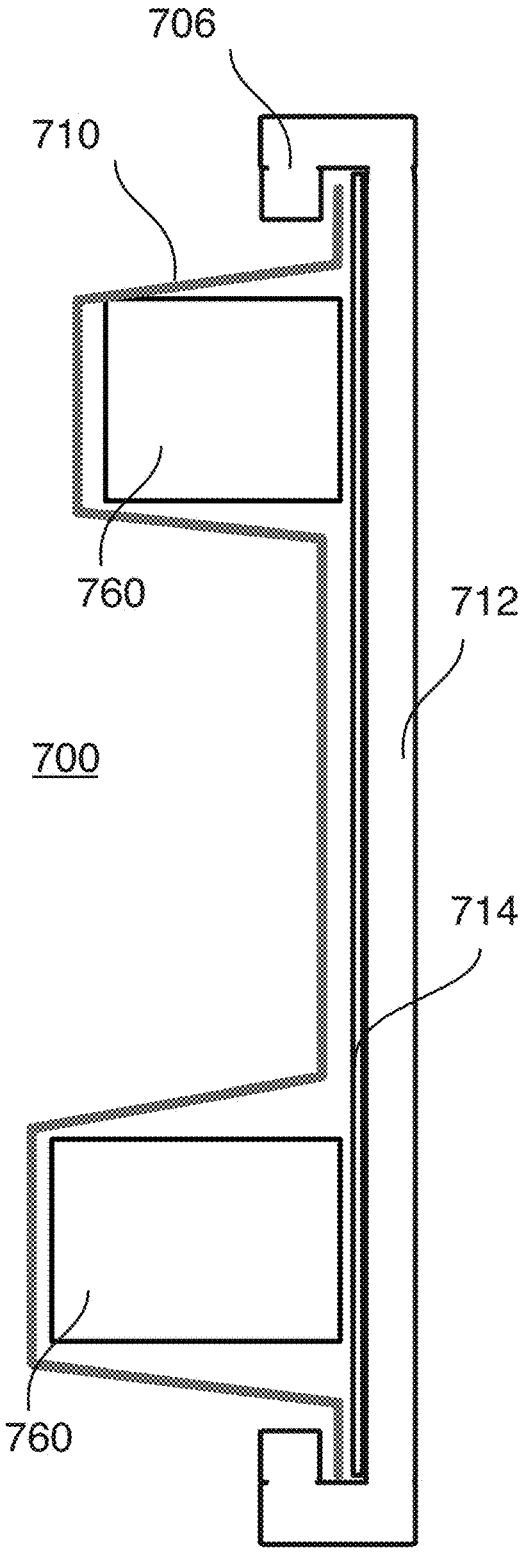
FIG. 7 is another exaggerated view of a cross-sectional view of another exemplary embodiment of the holder that includes an interior support material.

FIG. 7 is another exaggerated view of a cross-sectional view of another exemplary embodiment of the holder that includes an interior support material. The interior support material 714 can be utilize to add additional support structure, or a degree of stiffening to the holder 700. Thus, the support material 714 is sandwiched between the outside material 712 and the interior material 710 and magnets 760. The support material 714 and the interior material 710 are secured to the outside material by hem 706. The support material 714 can be any of a variety of material including cardboard, paper stock, cotton material, cloth material etc. In addition, in some embodiments, the support material 714 may be a ferromagnetic material. For instance, in one embodiment, only one panel of the holder may include the support material and that panel can eliminate the magnets. Thus, the magnets in the other panel would be attracted to and secure themselves to the support material. In other embodiments, the support material may simply be magnetic and a sheet of the material may be placed in each panel leaving open the adjoining area between the panels to facilitate folding.

Figure 8:
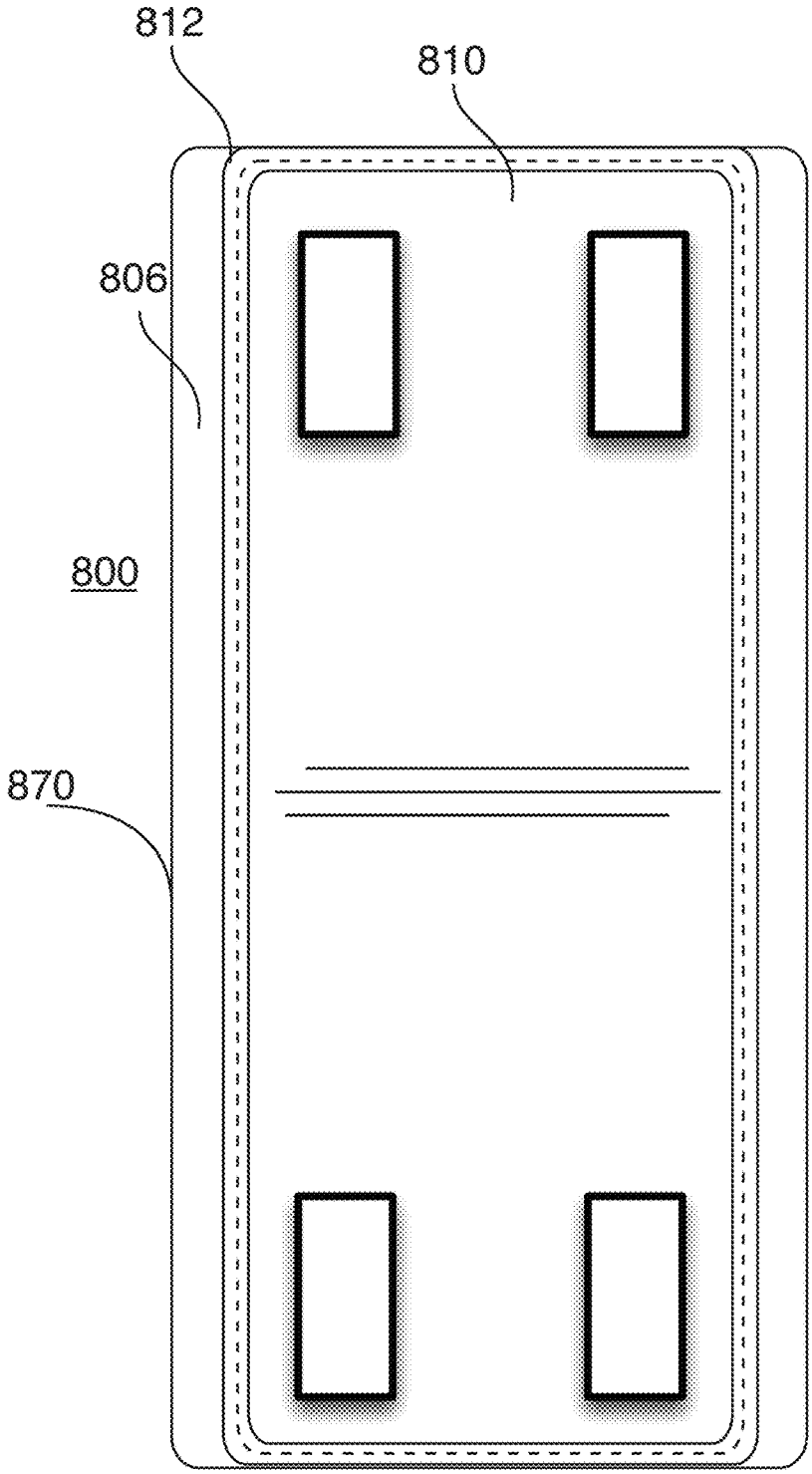
FIG. 8 is yet another embodiment of the pocket square holder.

FIG. 8 is yet another embodiment of the pocket square holder. In this embodiment, the outside material extends beyond the edge of the interior material a certain amount, such as a quarter to a half of an inch on the sides. In this embodiment, the outside material is chosen to be very flexible. A support material can again be placed between the outside material and the interior material but, would be approximately the same size as the interior material. Thus, in essence the hem 860 of the outside material 812 of the holder 800 would be significantly larger than in the other embodiments. This embodiment thus creates a pliable or flexible side edge 870 to the holder 800. In such an embodiment, the size of the interior material 810 and the support material (not shown) could be dimensioned to fit all pocket sizes and, the flexible edge 870 would easily give way to allow the holder 800 to be slid into small pocket sizes but, sufficiently stiff to prevent the holder from sliding around within the pocket interior.

Figure 9:
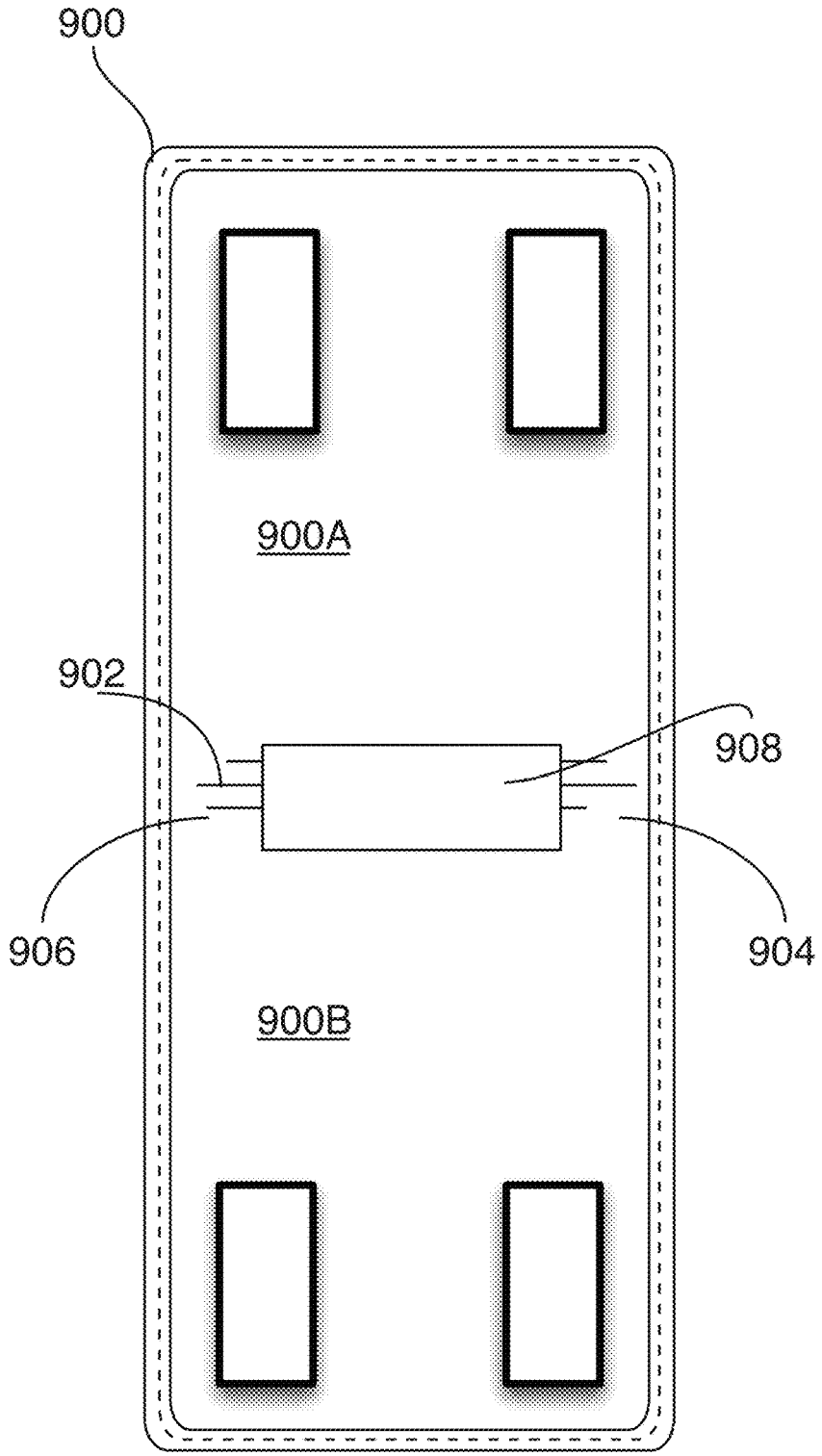
FIG. 9 is yet another embodiment of a pocket square holder.

FIG. 9 is yet another embodiment of a pocket square holder. In this embodiment, the holder 900 includes two panels 900A and 900B that are joined together along a single foldable edge 902. However, rather than being joined together along the entire edge, the panels are only joined together at tabs 904 and 906 thus having a gap 908 along the bottom edge through which a portion of the pocket square may extend.

Various modifications of the embodiments, in addition to those described herein, will be apparent to those skilled in the art from the foregoing description. Such modifications are also intended to fall within the scope of the appending claims. Although specific embodiments of the pocket square holder have been shown and described, it will be readily apparent to those skilled in the art that modifications may be made thereto which do not exceed the scope of the appended claims. Therefore, the scope of the invention is only limited by the following claims.

What is claimed is:

1. An apparatus for receiving and holding a pocket square, the apparatus comprising:

a first panel and a second panel, wherein the first panel and the second panel have a top edge, a left and a right side edge and a bottom edge, the first panel and the second panel being coupled together along their bottom edges forming a single foldable edge to create an interior area for receiving a folded pocket square when the first panel and the second panel are folded together along the single foldable edge;

a first set of two contacts associated with the first panel and a second set of two contacts associated with the second panel, wherein each of the first set of two contacts have an outer edge and the outer edge of one of the first set of two contacts is located three-eighths of an inch from the left side edge proximate to the upper left corner of the first panel and the outer edge of the other of the first set of two contacts is located three-eighths from the right edge and proximate to the upper right corner of the first panel and the second set of two contacts have an outer edge and the outer edge of one of the second set of two contacts is located three-eighths of an inch from the left side proximate to the upper left corner of the second panel and the outer edge of the other of the second set of two contacts is located three-eighths from the right edge and proximate to the upper right corner of the second panel such that when the first panel and the second panel are folded together along the single foldable edge, the first set of two contacts align with the second set of two contacts leaving a gap there between ranging from one and one eight inch to one and one fourth inch, and wherein the first set of two contacts and the second set of two contacts are magnetically drawn to each other whereby the first panel and the second panel are secured together;

an opening defined along the top edge of the first panel and the second panel when they are folded together along the single foldable edge, the opening configured such that a portion of the folded pocket square extends beyond the interior area; and wherein at least one of the first panel or second panel is dimensioned to fit securely within a pocket;

whereby the folded pocket square is held in between the first panel and second panel and between the aligned sets of contacts and a shape and a position of the folded pocket square are maintained and the folded pocket square is maintained within the interior area.

2. The apparatus of claim 1, wherein at least one of the first panel or the second panel is configured to fit within a pocket that is three inches wide and four inches tall or less.

3. The apparatus of claim 2, wherein when the first panel and the second panel are folded together along the single foldable edge, the thickness of the folded panels is one millimeter.

4. An apparatus for receiving and holding a pocket square, the apparatus comprising:

a first panel and a second panel, wherein the first panel and the second panel have a top edge, a left side edge, a right side edge and a bottom edge, the first panel and the second panel being coupled together along their bottom edges forming a single foldable edge to create an interior area for receiving a folded pocket square when the first panel and the second panel are folded together along the single foldable edge;

a securing element to hold the first panel and the second panel together when the first panel and the second panel are folded together along the single foldable edge, wherein the securing element includes a first set of metal contacts secured to the first panel and a second set of magnetic contacts secured to the second panel and wherein the first set of contacts and the second set of contacts have a depth that is one sixteenth of an inch and are positioned to be aligned with each other when the first panel and the second panel are folded along the single foldable edge such that a gap is created, wherein the gap is one eighth of an inch between the first and second panel and ranges between one and one eighth of an inch and one and one fourth of an inch between each of the contacts in the first set of metal contacts and the second set of magnetic contacts;

an opening defined along the top edge of the holder when the first panel and the second panel are folded together along the single foldable edge, the opening being configured such that a portion of the folded pocket square extends beyond an interior area; and wherein at least one of the first panel or second panel is dimensioned to fit securely within a pocket of a jacket;

whereby the folded pocket square is held in the holder and a shape and a position of the folded pocket square are maintained.

5. The apparatus of claim 4, wherein the dimensions of the first panel and the second panel are three inches wide and four inches tall.

6. The apparatus of claim 4, wherein the first and second panels include an outer material and an interior material joined together along the edges of the panels.

7. The apparatus of claim 4, wherein the first and second panels include an outer material and an interior material joined together along the edges of the panels and a support material sandwiched between the outer material and the interior material.

8. An apparatus for receiving and holding a pocket square, the apparatus comprising:

a first panel and a second panel, wherein the first panel and the second panel have a top edge, a left and a right side edge and a bottom edge, the first panel and the second panel being coupled together along their bottom edges forming a single foldable edge to create an interior area for receiving a folded pocket square when the first panel and the second panel are folded together along the single foldable edge;

a first set of two contacts associated with the first panel and a second set of two contacts associated with the second panel, wherein each of the first set of two contacts have an inner edge and the inner edges the two contacts of the first set of two contacts are at least one and one eighth inches to one and one fourth inches apart and less than three inches apart, and wherein each of the second set of two contacts have an inner edge and the inner edges the two contacts of the second set of two contacts are at least one and one eighth inches to one and one fourth inches apart and less than three inches apart, and each of the first set of two contacts and second set of two contacts include a depth such that when the first panel and the second panel are folded together along the single foldable edge, the first set of two contacts align with the second set of two contacts leaving a gap between the first panel and second panel equal to the combined depths of the first set of two contacts and the second set of two contacts, and wherein the first set of two contacts are ferromagnetic and the second set of two contacts are either ferromagnetic or metallic such that the first set of two contacts are magnetically drawn to the second set of two contacts whereby the first panel and the second panel are secured together;

an opening defined along the top edge of the first panel and the second panel when they are folded together along the single foldable edge, the opening configured such that a portion of the folded pocket square extends beyond the interior area;

whereby the folded pocket square is held in between the first panel and second panel and between the aligned sets of contacts and a shape and a position of the folded pocket square are maintained and the folded pocket square is maintained within the interior area.

* * * * *